United States Patent [19]

Phillips

[11] 3,983,728

[45] Oct. 5, 1976

[54] DOUBLE CHANGEABLE KEY LOCK FOR SAFE DEPOSIT BOXES AND THE LIKE

[75] Inventor: Peter J. Phillips, Redando Beach, Calif.

[73] Assignee: Sargent & Greenleaf, Inc., Rochester, N.Y.

[22] Filed: Oct. 23, 1974

[21] Appl. No.: 517,399

[52] U.S. Cl. ..... 70/339; 70/383

[51] Int. Cl.[2] ..... E05B 35/12

[58] Field of Search ..... 70/339, 355, 382, 383, 70/384, 377

[56] References Cited

UNITED STATES PATENTS

| | | | |
|---|---|---|---|
| 690,537 | 1/1902 | Taylor | 70/384 |
| 1,125,343 | 1/1915 | Klohs | 70/339 X |
| 1,259,353 | 3/1918 | Brintnall | 70/384 |
| 1,384,179 | 7/1921 | Christoph | 70/364 R |
| 1,522,573 | 1/1925 | Benham | 70/339 X |
| 1,693,731 | 12/1928 | Sioberg | 70/383 |
| 1,826,595 | 10/1931 | Benham | 70/339 X |
| 2,221,664 | 11/1940 | Susser | 70/384 |
| 2,832,211 | 4/1958 | Saarento | 70/377 X |
| 3,514,982 | 6/1970 | Bergendahl | 70/384 X |
| 3,772,904 | 11/1973 | Parrock | 70/383 X |
| 3,837,196 | 9/1974 | Gartner et al. | 70/383 X |

*Primary Examiner*—Roy D. Frazier
*Assistant Examiner*—Thomas J. Holko
*Attorney, Agent, or Firm*—Mason, Fenwick & Lawrence

[57] ABSTRACT

A changeable combination key lock for safe deposit boxes and the like, wherein a guard key is insertable into a rotatable guard key plug to set guard key tumblers to permit retracting movement of a bolt, and a renter's key is insertable into a rotatable renter's key plug for engagement with renter's key tumblers to aline them to permit retraction of the bolt. Both the renter's key tumblers and the guard key tumblers are releasable from gate members carried by the bolt and may be set for key configuration for a new renter's key and a new guard key, or either of them, when the lock is conditioned in a change mode to permit adjustment of the lock to operate with different guard keys and renter's keys.

19 Claims, 8 Drawing Figures

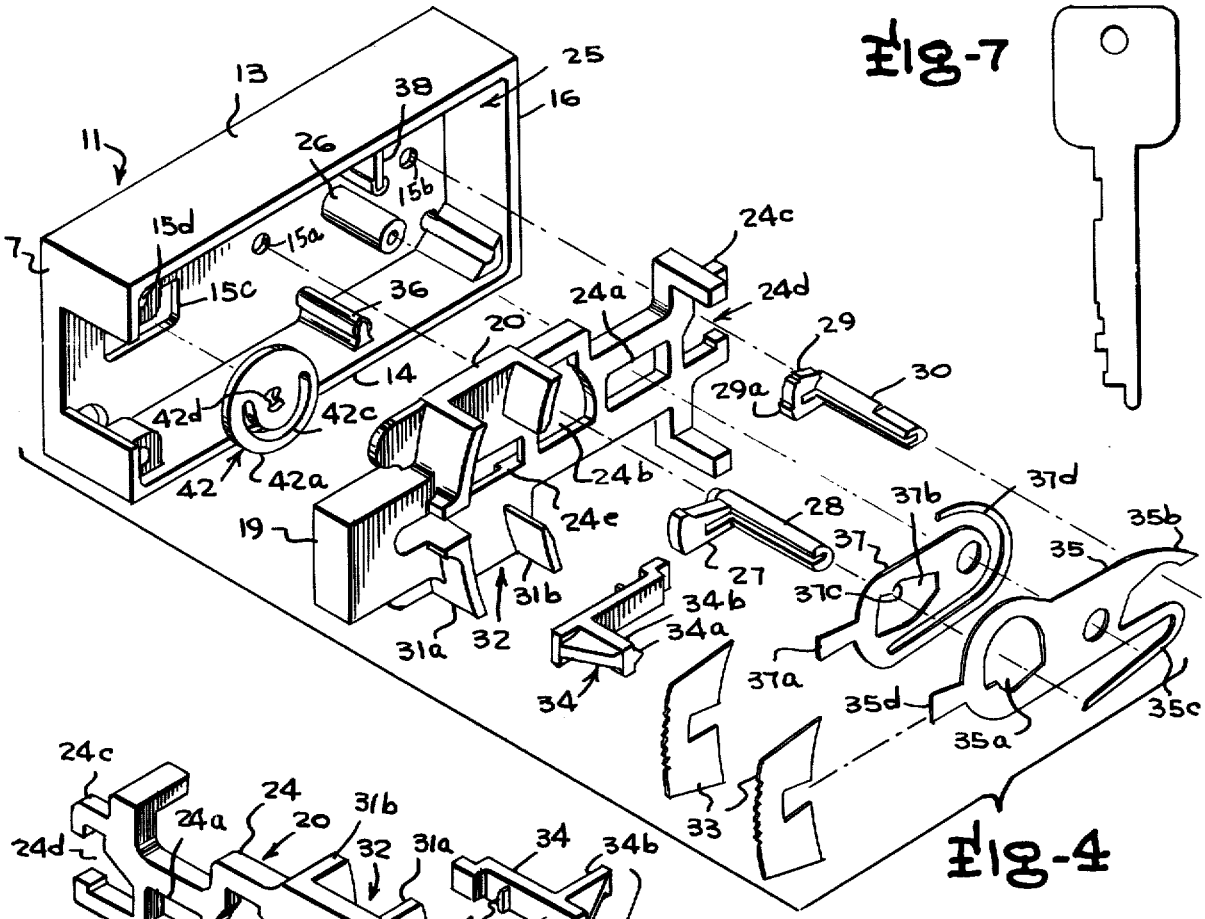
Fig-7
Fig-4
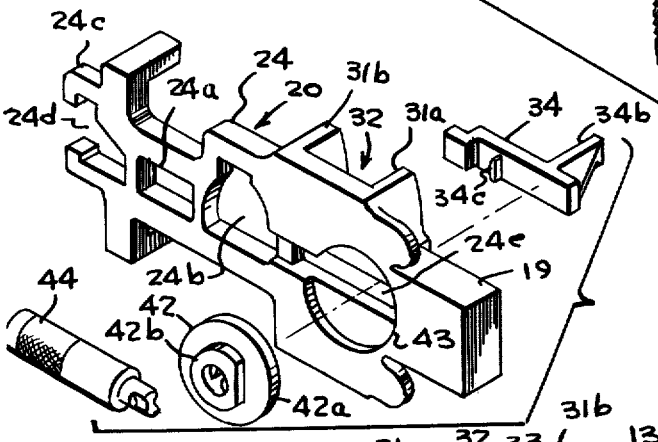
Fig-5
Fig-6
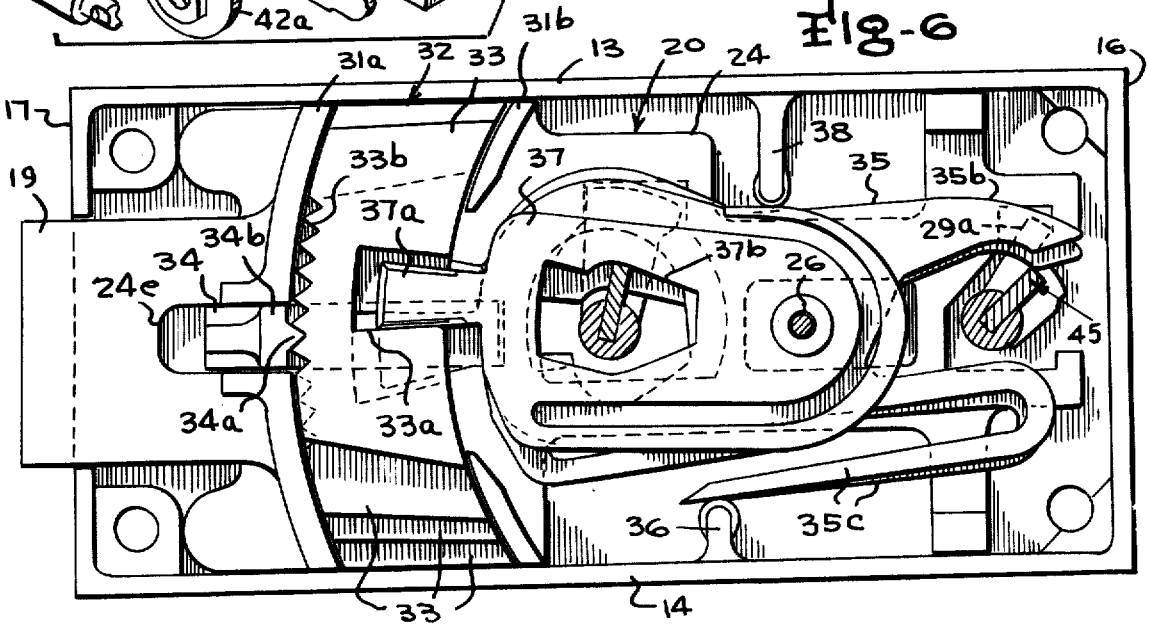

DOUBLE CHANGEABLE KEY LOCK FOR SAFE DEPOSIT BOXES AND THE LIKE

BACKGROUND AND OBJECTS OF THE INVENTION

The present invention relates in general to key locks, and more particularly to key locks for safe deposit boxes and the like, wherein both a guard key and a renter's key having a proper configuration on the key bit must be inserted into the lock and rotated to effect retraction of the bolt.

It will be appreciated that safe deposit boxes in bank vaults and similar security installations are successively leased to different parties, to whom the lessor furnishes a renter's key adapted to open a given safe deposit box when the lock is partially operated or armed by a guard key in the possession of the lessor. Often, lessees fail to return the renter's key at the expiration of their lease, or the lessee may lose the renter's key, and it becomes necessary in such cases to change the safe deposit key lock so that it can be operated by a renter's key bit having a different configuration. Also, even if the lessee returns the renter's key at the expiration of his lease, it is desirable to change the key bit configuration to which the lock is responsive whenever the lessee of the box is changed, to prevent the otherwise possible use of an unauthorized duplicate of the renter's key which may have been made before the renter's key was returned.

For this reason, certain safe deposit box locks have been made in such a manner that the position of the gatings in the tumblers operated by the renter's key is changeable, so that the position of the gatings may be adjustably set to be opened by a different renter's key. The typical practice in this regard has been to provide a change key in the form of a non-round cross-section rod which is insertable into an opening in the safe deposit lock case or rear cover wall and through shaped openings in the renter's key tumblers, when the safe deposit lock has been activated by the old renter's key. The combination change key interfits into shaped openings in one of two pivoted companion tumbler sectors for each of the renter's key tumbler levers, all of which tumbler lever sectors are pivoted on a fixed tumbler post, to decouple the normally mated tumbler lever sectors of each of these tumbler levers and permit them to be recoupled in a position corresponding to the configuration of the bit of a new renter's key.

It has become recognized that it is also desirable to provide for resetting of the guard key tumbler lever system in accordance with different guard key configurations, so that the guard key to be used with safe deposit locks can be changed from time to time to provide greater security or to reset the locks when the guard key is lost or when change of guard personnel occurs. Attempts to provide for changing of the lock to accommodate to different guard keys as well as different renter keys have generally involved use of renter's key tumbler levers which are each made up of two pivoted companion tumbler sectors which may be selectively decoupled when the lock is in a change mode to permit relative adjustment of one of the tumbler sectors with respect to the other to accommodate to the configuration of the bit of the new renter's key, and also using an entirely different set of guard key tumbler levers disposed in a portion of the lock housing spaced from the renter's key tumbler levers and a plurality of independently adjustable fence members positioned relative to the guard key tumblers capable of being set to different positions in accordance with different guard key configurations. Such a construction requires a considerably larger space consuming lock configuration and considerably increases complications and expense in the assembly of safe deposit lock units.

An object of the present invention is the provision of a novel construction of a tumbler lever lock for safe deposit boxes and the like, having a first group of tumbler levers to be set by a guard key, and a second group of tumbler levers to be set by a renter's key, disposed in alternating side by side relation in the lock housing, together with gate members movable with a bolt and setable to different positions relative to the tumbler levers in accordance with different renter's key and guard key configurations, wherein the renter's key and guard key tumbler levers normally occupy interfering positions relative to the gate members to permit movement of the bolt and gate members until the tumbler levers are set by the proper keys.

Another object of the present invention is the provision of a novel key lock of the tumbler lever types for safe deposit boxes and the like, having a plurality of renter's key operated tumbler levers and guard key operated tumbler levers each having a body section movable arcuately by the appropriate key and each having associated therewith a gating section movable with the bolt, which sections may be selectively decoupled to place the lock in a combination change mode for adjustment to the configuration of different renter's keys and guard keys.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 4 is a fragmentary, exploded perspective view of a portion of the locking bolt and portions of two adjacent tumbler levers employed in the safe deposit box lock;

FIG. 5 is an exploded perspective view of the bolt plate of the safe deposit box lock with the gate locator and release cam;

FIG. 6 is a view similar to FIG. 3 with the lock in normally unlocked position;

FIG. 7 is an elevation view of a typical guard key or renter's key, for use in the lock of the present invention.

DETAILED DESCRIPTION OF A PREFERRED EMBODIMENT

Figure 1:
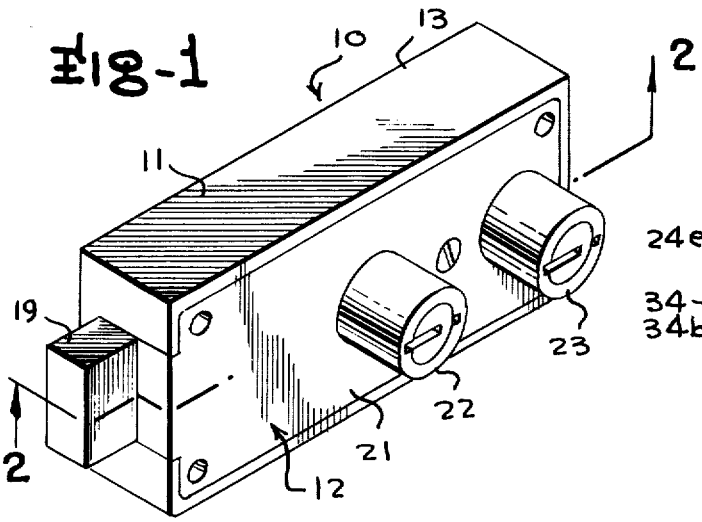
FIG. 1 is a front perspective view of a changeable lock for safe deposit boxes, embodying the present invention.
Figure 8:
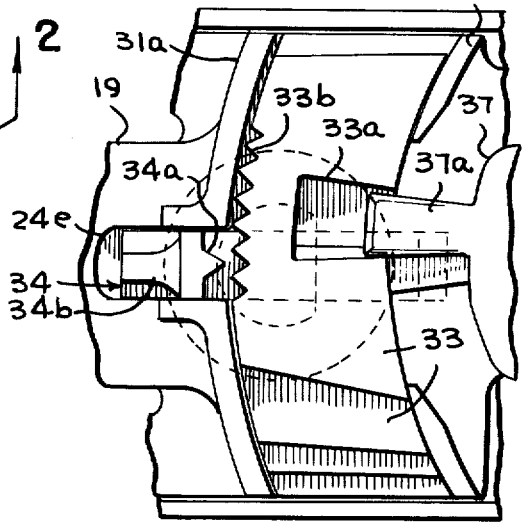
FIG. 8 is a fragmentary front elevation view of the gate members, the gate holding locator, and portions of the bolt and tumbler levers, with the gate holding locator in release position.

Referring to the drawings, wherein like reference characters designate corresponding parts throughout the several figures, the key operated, tumbler lever type, double changeable lock for safe deposit boxes of the present invention is indicated generally by the reference character 10 and comprises a lock case 11 and a cover plate 12 removable therefrom. In accordance with conventional practice, the lock case is a generally rectangular housing in the form of a forwardly opening box-like structure to be forwardly closed by the cover plate 12, and comprises parallel top and bottom walls 13, 14, a rear wall 15, and end walls 16 and 17. The end wall 17 has an opening therethrough, indicated at 18, through which the locking bolt portion 19 of the bolt and bolt plate member 20 projects. The front cover plate 12 comprises a front panel or wall 21, having a plurality of openings by which the cover plate is fastened by screws or the like to the case 11 in forwardly closing relation to the case. The cover plate 12 has a pair of forwardly projecting horns or annular bosses 22, 23, one of which serves as the horn for the renter's key, and the other which serves as the horn for the guard or preparatory key. In the illustrated embodiment, the horn 22 is the renter key horn and the horn 23 is the guard key horn. These horns 22 and 23 serve as outwardly surrounding tubular bearings for the hubs or plugs, to be later described, for the renter's key and the guard key, and extend through the customary circular openings provided therefor in the door of the conventional safe deposit box compartment or chamber. The corners of the lock case 11 are provided with customary holes extending therethrough for fastening bolts projecting into tapped openings in the conventional safe deposit compartment door to mount the assembled case and cover plate against the inner surface of the door.

The bolt and bolt plate member 20, hereinafter frequently referred to as the bolt plate member, includes the usual heavy bolt portion 19 in the form of a thick rectangular block which projects from the lock case 11 into a conventional keeper, and includes an integral bolt plate portion 24 of lesser thickness extending from the thicker bolt portion 19 through the major portion of the mechanism chamber 25 of the lock casing in forwardly overlying relation immediately adjacent the rear wall 15 of the case. The bolt plate member 20 is guided for rectilinear projecting and retracting movement relative to the casing by sliding engagement of the upper and lower edges of the bolt plate portion 24 and the bolt portion 19 with adjacent portions of the casing. A tumbler lever mounting post 26 projects integrally forwardly from the rear wall 15 of the case 11 and is accommodated in an elongated slot **24*a* in the bolt plate portion 24 permitting relative sliding movement of the bolt through its reciprocative path between projected and retracted positions. The bolt plate portion 24 also includes a shaped opening 24*b* in its midportion to receive the operating tang or cam 27 and the end of the constricted diameter hub portion of the plug 28 for the renter's key, and terminates at its end opposite the bolt portion 19 in a yoke or bifurcated end portion defining vertically spaced upper and lower arms 24*c* bounding a shaped opening 24*d* for receiving the operating tang or cam 29 and the constricted diameter hub portion of the plug 30 for the guard key. The bolt plate member 20 also includes a forwardly projecting interrupted arcuate flange 31*a* adjacent the juncture of the bolt portion 19 and bolt plate portion 24 and a pair of arcuate flange segments 31*b* spaced therefrom defining a forwardly opening arcuate guide channel 32 therebetween for slidably supporting a stack of gate members 33, to be later described in greater detail. An elongated guide slot 24*e* is also provided in the bolt plate portion 24 and extending into the bolt portion through the interruption in the arcuate flange 31*a* for slidably receiving and guiding a gate locking member 34** to be later described.

Two types of tumbler levers are mounted for pivotal or arcuate movement on the tumbler post 26, in interleaving or alternating relation. One type of tumbler lever is referred to herein as guard key tumbler levers 35, having a circular aperture in their midregion which fits about the tumbler mounting post 26 to pivot the tumbler levers 35 thereon, and each include a shaped opening **35*a* receiving the hub portion of the plug 28 for the renter's key and the bit portion of the renter's key, the opening being large enough to accommodate the bit portion of the renter's key without contacting the edge of the key so that the guard key tumbler levers are not positioned in any way by the renter's key. The guard key tumbler levers 35 also each include a rearward tail portion 35*b* disposed in the zone of operation of the guard key, having a shaped lower edge adapted to contact the guard key bit when the guard key is rotated to adjust the guard key tumbler levers 35 to angular positions in accordance with the shape of the guard key. An integral spring extension 35*c* projects along a generally U-shaped path from the lower rear edge portion of each guard key tumbler lever 35 to bear upon a surface, such as the rib formation 36 of the lock casing and bias the associated guard key tumbler lever in a clockwise direction as viewed in FIG. 3, and the opposite end of each guard key tumbler lever 35 has a forwardly projecting fence formation or truncated triangular projecting nose 35*d* to be alined with and receive the gating recess 33*a* opening through the concave edge of the associated gate member 33 when the proper guard key is inserted in the guard key horn 33 and is rotated, for example clockwise through 90° from the 3 o'clock position, as viewed from the front of the lock, to the 12 o'clock position to bring the shaped edges of the guard key bit into contact with the key follower surfaces at the lower edge of the rearward tail portions 35*b* of the guard key tumbler levers to angularly position the guard key tumbler levers about the tumbler post 26 so as to aline the fence formations 35*d* to receive the gating recesses 33*a* in the associated gate members 33**.

Figure 2:
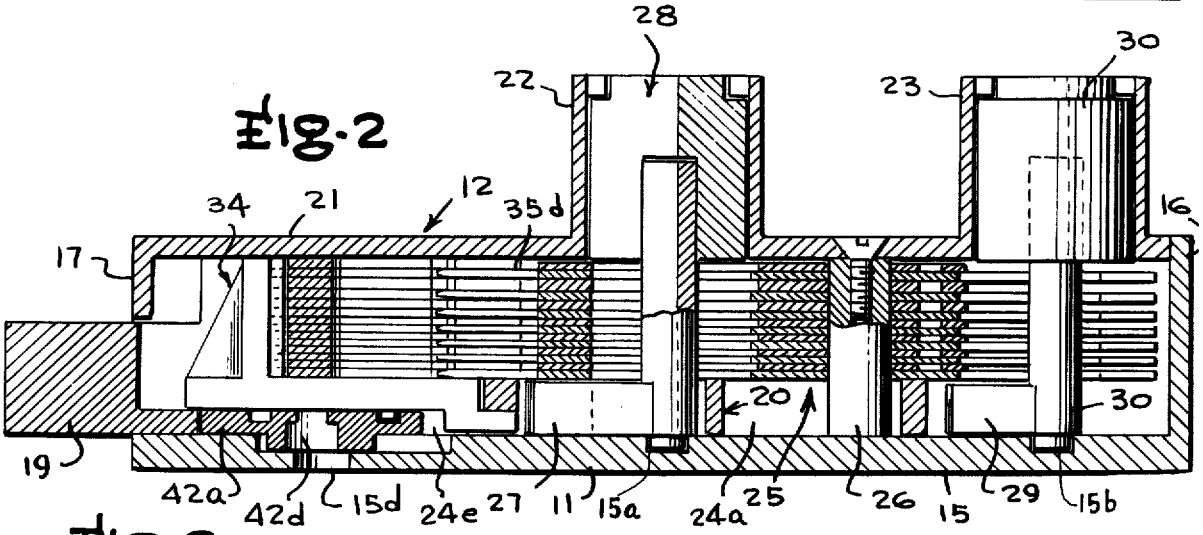
FIG. 2 is a horizontal longitudinal section view taken along the line 2—2 of FIG. 1.

The other type of tumbler lever is hereinafter referred too as a renter tumbler lever and is indicated by the reference character 37. The renter key tumbler levers 37 are interposed between successive pairs of the guard key tumbler levers 35, so that the two types of tumblers occur in alternation, as will be apparent from inspection of FIG. 2. The renter tumbler levers 37 each comprise a body of thin flat metal sheet stock or similar material, like the guard key tumbler levers, having a round aperture in its midregion to fit about the tumbler mounting post 26 to pivot the renter tumbler levers 37 thereon for arcuate movement responsive to a renter key and having a forwardly projecting fence or nose formation 37a shaped similar to the fence formation 35d on the guard key tumbler levers to be selectively received in gating recesses **33*a* of the associated gate members 33. Between the circular aperture for the tumbler mounting post and the fence formation 37*a* is a shaped opening 37*b* for receiving the bit portion of the renter's key and the constricted diameter hub portion of the plug 28, having a key follower surface 37*c*** along the upper region of the opening 37*b* to be engaged by the key bit portion when the key is inserted in the renter's key horn 22 and rotated, for example clockwise through 90° from the 3 o'clock position, as viewed from the front of the lock, to the 12 o'clock position to engage the key follower surfaces 37*c* and angularly position the renter tumbler levers properly about the tumbler post 26 to aline the fence formation 37*a* with the gating recesses 33e in the appropriate gate members 33. The renter tumbler levers 37 are considerably shorter than the guard key tumbler levers, as they terminate toward the bolt end of the lock from the zone of operation of the guard key, and include a curved integral spring extension formation 37*d* in the illustrated embodiment, which bear against an integral rib formation 38 provided along the top wall of the casing and bias the renter tumbler levers 37 in a counterclockwise direction as viewed in FIG. 3. It will be appreciated that the integral spring formations 35*c* and 37*d* may be dispensed with, if desired, and instead spring wire members or similar spring devices of conventional configuration may be joined to the tumbler levers, or spring members may be fixed on the casing and bear against edges of the tumbler levers to bias the tumbler levers in the appropriate directions.

The center bore in the renter key horn 22 and in the guard key horn 23, and alined circular apertures 15*a* and 15*b* in the rear wall 15 of the lock case 11 form the journal openings for the rotatable key plugs 28 and 30, the hub portion of each plug having a smaller diameter circular or cylindrical end portion which rotatably interfits in the associated circular socket 15*a* or 15*b*. Each of the key plugs have a slot therein extending from substantially the center axis of the plug radially through one side thereof along most of the length of the constricted diameter hub portion and through the larger diameter front portion of each plug to define the keyway for the associated key. Fixed to the rear end portion of the renter key plug or cylinder 28, immediately inwardly of the interior surface of the rear case wall 15, is a tang, drive cam or actuator 27 which, in the illustrated embodiment, is integrally formed with the constricted hub portion of the associated plug but may be separately formed with a collar and fixed onto the hub or otherwise secured thereto. The actuator or cam 27 is in the form of a radially extending projection which normally occupies the shaped opening 24*b* of the bolt plate portion 24 and has a nose formation on the outer edge thereof, in the preferred embodiment, which bears against the surface of the shaped opening 24*b* after the renter's key has been rotated from the 9 o'clock position clockwise to about an 11 o'clock or 11:30 position, whereupon further rotation of the renter's key and the actuator 27 to about a 1 o'clock position, assuming a proper guard key has been inserted and turned, withdraws the bolt from locking relation with the keeper to unlocking position.

The hub portion of the guard key plug 30 also has an actuator or tang 29 immediately adjacent the interior surface of the rear case wall 15 in the form of a radially extending projection lying in the shaped opening 24*d* of the bolt plate portion 24 between the yoke arms 24*c* shaped so that when the proper guard key is rotated from the 9 o'clock position to approximately the 12 o'clock position, the extension shoulder formation 29*a* is positioned upwardly out of blocking relation to the forward surface portion 24*d'* freeing the bolt plate 20 to move under the influence of the actuator 27 when the proper renter's key is inserted and rotated.

As will be apparent from the drawings, the convex edges of the gate members 33, which are the edges nearest the bolt portion 19 or the bolt end of the lock casing, are provided with a series of teeth or serrations 33*b* facing in confronting relation a triangular tooth formation or holding tooth 34*a* on the forwardly extending flange portion 34*b* of the gate locking member or gate locator 34. The forwardly extending flange portion 34*b* lies in the interrupted portion of the interrupted arcuate flange 31*a* and the range of movement of the gate locking member 34 in its slot 24*e* is such as to permit the gate locator 34 to be moved from a position wherein the tooth 34*a* is interfitted in holding relation with the teeth 33*b* of the gate members to a retracted position wherein it is withdrawn from the gate member teeth 33*b* so that the gate members are free to be moved in the guide channel 32 to different positions. The positioning of the gate locking member 34 in the holding position or the release position is governed by a gate release cam 42 having a circular body portion 42*a* journaled in a correspondingly shaped circular recess 43 in the rear surface of the bolt plate portion 24. The gate release cam 42 has a rearwardly projecting hub portion 42*b* which extends into an elongated slot 15*c* in the rear wall 15 of the case and has a spiral cam groove 42*c* facing forwardly therein receiving a lug or projection 34*c* of the gate locator 34. The gate release cam 42 also has a key slot therein, indicated at 42*d*, which registers with a circular keyhole or tool hole 15*d* in the rear case wall 15 when the lock has been manipulated in the subsequently described fashion to condition it for going into the change mode, so that the change key or change tool 44 can be inserted in the opening to rotate the gate release cam 42 through 180° whereby tracking of the lug 34*c* in the spiral cam groove 42*c* retracts the gate locking member 34 from locking engagement with the teeth 33*b* of the gate members 33.

Figure 3:
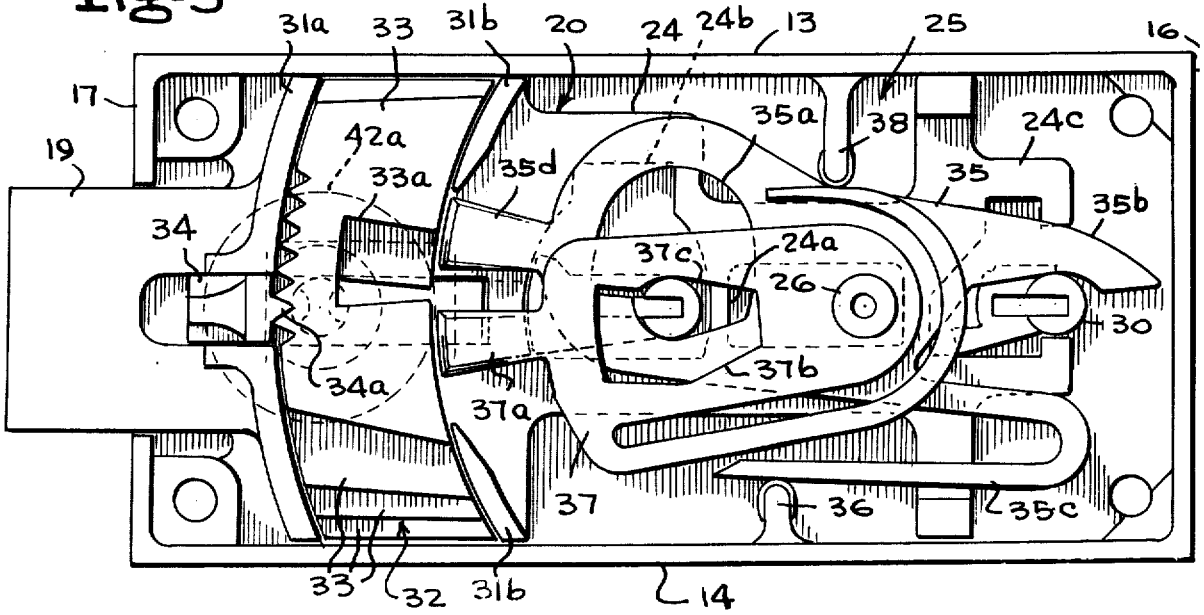
FIG. 3 is a front elevation view of the safe deposit box lock, with the cover removed.

In the following description of operation of the lock, the key positions are indicated as viewed from the front of the lock or as viewed in FIG. 3. In the operation of the safe deposit box lock, the guard key, such for example as the key 45 illustrated in FIG. 6, is inserted into the key cylinder or plug 30 in the guard key horn 23 at approximately the 9 o'clock position and is rotated from that position to the 12 o'clock position disposing the bit of the key 45 in a substantially upwardly extending vertical plane with the shaped edge of the bit bearing upwardly against the tail portions 35*d* of the guard key tumbler levers 35. This insertion and movement of the guard key 45 rocks the guard tumbler levers 35 about the tumbler post 26 to a position alining each of the fence formations 35*d* with the gating recesses 33*a* of those gate members 33 associated with the respective guard key tumbler levers. The proper renter's key 46 is then inserted into the key cylinder or plug 28 of the renter horn 22 and is rotated from the 9 o'clock insertion position clockwise to almost the 12 0'clock position to bring the key bit into engagement with the key follower edges 37*c* in the shaped openings 37*b* of the renter tumbler levers 37 to rock the renter tumbler levers 37 about the tumbler post 26 to a position disposing their fence formations 37*a* in alinement with the gating recesses 33*a* of the gate members 33 associated with the renter tumbler levers 37. Additional rotation of the renter's key clockwise from the position closely approaching the 12 o'clock position rotates the actuator or tang 27 on the renter plug 28 into engagement with the vertical bounding surface portion of the shaped opening **37*b* at the right-hand side of this opening as viewed from the front, forcing the bolt plate to the right to a sufficient extent to retract the bolt portion 19 to a normal unlocking position. Return of the renter's key in the counterclockwise direction brings the opposite or left-hand edge of the tang 27 into engagement with surfaces of the shaped opening 37*b* to return the bolt to the projected position when the renter's key 46 is returned to the 9 o'clock position. The range of movement of the bolt plate 20 is such that when the bolt plate is adjusted fully to the projected or locked position, which is reached in the illustrated example when the renter's key reaches about a 10 o'clock or 10:30 position, the concave edges of the gate members 33 are spaced slightly toward the bolt end of the case from the outermost ends of the fence formations 35*d* and 37*a*, thus fully withdrawing the fence formations from the gating recesses 33*a* when the bolt plate and the gate members 33** carried thereby are moved fully to the locked or projected position of the bolt.

When it is desired to change the combination settings of the gate members 33 to operate with either a different renter's key or a different guard key, the lock is first operated by the guard key and the customer or renter's key for which it is presently set in the usual manner to retract the bolt to unlocked position and the safe deposit compartment door or other door on which the lock is mounted is opened. The renter's key is then returned to a position, which may be about an 11 o'clock position, to return the bolt to an intermediate projected position near but not completely projected, at which position the change key or change tool opening **42*d* in the gate release cam 42 becomes alined with the change keyhole 15*d* in the rear wall of the case. The tool end of the change key or change tool 44 is then inserted through the opening 15*d* into the slot 42*d* and is rotated through 180°, rotating the gate release cam 42 through a similar angle and thereby shifting the gate locator or gate locking member 34 to the release position due to the action of the spiral cam groove 42*c* on the lug 34*c* of the gate locator 34. At this intermediate position of the bolt plate 20, the outer ends of the fence formations 35*d* and 37*a* are not yet withdrawn from the gating recesses 33*a* in the gate members 33, so that the gate members and the tumbler leaves remain intercoupled, and the flat 42*e* on the hub 42*b* of gate release cam 42 is now located toward the guard key end of the casing so that the hub 42*b* now has a range of movement in slot 15*c* enabling the bolt plate 20 to retract far enough to permit the renter's key and guard key to be turned to the 3 o'clock position. the renter's key or customer key is then rotated clockwise to the 3 o'clock position, where it can be withdrawn, and the new renter's key may be inserted in the renter hub 28, and/or the prior guard key can be rotated to and withdrawn at the 3 o'clock position and a new guard key inserted. The new guard key, if inserted, is rotated upwardly until the tang or actuator 29 engages the surface of the shaped opening 24*d*, and the new renter's key is rotated upwardly counterclockwise to bring the tang or actuator 27 into contact with the surfaces of the shaped opening 24*b* and effect return of the bolt plate 20 to the intermediate or combination change projected position. During this upward movement of the renter's key and/or guard key, the surfaces of the key bit come into engagement with the key follower surfaces of the tumbler levers and adjust the angular positions of the tumbler levers and their intercoupled gate members 33 to proper positions for the new keys. The key openings 24*b* and 24*d* are shaped to locate abutment shoulders so as to abut the tangs 27 and 29 before the guard and renter's keys can be turned fully to the 9 o'clock position when the flat on the gate release cam hub 42*b* faces the guard key end of the case, so that keys can only be removed at the 3 o'clock position which the lock is in this change mode. With the renter's key positioned at the proper angle to again register the key slot 42*d* in the gate release cam 42 with the tool hole 15*d*, the change tool or change key 44 is again inserted to rotate the gate release cam 42 through 180° back to the initial position reengaging the holding tooth 34*a* of the gate locator 34 in intermeshed relation with the teeth 33*b* of the gate members 33 to hold the gate members in the newly adjusted position for the new keys. The tool 44 is then withdrawn, and the renter and guard keys are returned in normal fashion to the initial or 9 o'clock position for removal in the customary manner. The bolt plate is now permitted to move to the fully projected position since the flat on the hub of the gate release cam 42 now faces the bolt end of the case and permits such full projecting movement of the bolt plate before the flat engages the end of the slot 15*c*** nearest the bolt.

What is claimed is:

1. A lock requiring two different keys for operation of the lock to unlocking position, comprising a lock housing, a slide bolt mounted in the housing for sliding movement between projected and retracted positions, a aplurality of gate members each having a gating recess, means mounting said gate members in said housing for movement with said slide bolt, first and second rotatable key plugs at first and second key stations in said housing spaced apart along the direction of bolt movement, a first set of a plurality of renter key tumbler levers to be positioned by a renter key in the first key plug, means for mounting said renter key tumbler levers in said housing positioning them normally in interfering relation to a first set of said gate members and mounting said renter key tumbler levers for movement under operation of said renter key in said lock to a noninterfering position, a second set of a plurality of guard key tumbler levers to be positioned by a guard key in said second key plug, means for mounting the guard key tumbler levers in said housing positioning them normally in interfering relation to a second set of said gate members and mounting them for movement under operation of said guard key in said second key plug to a non-interfering position, both sets of said tumbler levers having portions disposed to engage said gate members and prevent movement of said slide bolt to unlocking position until both said renter key and said guard key have been inserted in said lock and are positioned to concurrently hold said two sets of tumbler levers in said non-interfering position relative to said two sets of gate means whereby the gate members are then released to permit retraction of said bolt to unlocking position, said bolt including gate locator means having a projection to be interfitted in holding relation with an edge of each of said gate members and movable between a gate-holding and gate-releasing position, and a gate release cam accessible from externally of the lock housing when the bolt is in a preselected intermediate position to be manipulated for shifting said gate locator means between gate-holding and gate-releasing positions.

2. A lock as defined in claim 1, wherein said means for mounting said gate members includes means for releasing both said first and second sets of said gate members from said bolt to enable their positions to be changed relative to said bolt and relative to the profile of the keys required to aline said gate members and tumbler levers in non-interfering positions, whereby either or both of the keys required to operate the lock may be changed.

3. A lock as defined in claim 1, wherein said gate members include gate openings facing toward said tumbler levers having inwardly divergent side edges, said tumbler levers having fence projections adapted to interfit into said gate openings having outwardly divergent side edges, said gate members being releasable from said bolt to assume different positions relative to said tumbler levers, and said gate members being movable arcuately by said tumbler levers when released from said bolt to enable changing of the first and second keys required to open said lock.

4. A lock as defined in claim 1, wherein said first and second sets of tumber levers are pivotally mounted on a common axis in said housing between said key stations.

5. A lock as defined in claim 4, wherein said guard key tumbler levers each have an opening encircling said first key plug of sufficient size to maintain the associated guard key tumbler levers free of any contact with the renter key in said first key plug.

6. A lock as defined in claim 5, wherein said tumbler lever axis and said key-receiving rotatable plugs are located substantially in line with each other along a common mid-plane of said lock.

7. A lock as defined in claim 1, wherein at least some of said tumbler levers are substantially symmetrical about a midplane through the tumbler lever to facilitate their assembly into the lock.

8. A lock as defined in claim 1, wherein at least some of said tumbler levers include key follower surfaces to be engaged by the associated key, which are formed on interior surfaces of apertures formed in said tumbler levers.

9. A lock as defined in claim 1, wherein said gate release cam is rotatable and is carried by said bolt and intercoupled with said gate locator means for shifting the same between said gate-holding and gate-releasing position, said gate release cam being alinable with an opening in said housing when said bolt is in a preselected intermediate position between said projected and retracted positions for insertion of a tool to shift the gate release cam between positions disposing said gate locator means at said gate-holding and gate release positions.

10. A multiple key lock for safe deposit boxes and the like comprising a lock housing, a bolt slidably supported in said housing for movement between a projected locking position and a retracted unlocking position, a plurality of platelike gate members releasably carried by said bolt to prevent movement of the bolt from said locking position toward unlocking position until a plurality of mating tumbler levers operated by a renter's key and a guard key are alined in selected relation to each of the gate members, the improvement permitting changing of both the renter's key and the guard key for opening the lock comprising a first set of plurality of renter's key tumbler levers pivotally mounted adjacent one end on a common pivot axis and having first key follower surfaces on each tumbler lever thereof to be engaged by a renter's key insertable in said lock at a renter's key station, the lock having renter's key-receiving means spaced laterally of said common pivot axis and located adjacent said key follower surfaces, and a second set of a plurality of guard key tumbler levers pivotally mounted on said common pivot axis and having second key follower surfaces on each said guard key tumbler lever to be engaged by a guard key insertable in said lock at a guard key station spaced from said renter's key station, the lock having guard key-receiving means spaced laterally of said common pivot axis oppositely disposed relative to the renter's key receiving means, whereby adjustment of the gate members carried by said bolt relative to each of the two sets of tumbler levers permits changing of the customer and guard keys, said bolt including gate locator means having a projection to be interfitted in holding relation with an edge of each of said gate members and movable between a gate-holding and gate-releasing position, and a gate release cam accessible from externally of the lock housing when the bolt is in a preselected intermediate position to be manipulated for shifting said gate locator means between gate-holding and gate-releasing positions.

11. A multiple key lock as defined in claim 10, wherein said tumbler levers are each symmetrical about a mid-plane of the tumbler lever extending through common pivot axis and said key follower surfaces are formed on inner edges of apertures extending through the tumbler levers.

12. A multiple key lock as defined in claim 11, wherein said renter's key-receiving means and said guard key-receiving means and said common pivot axis are all substantially alined along a mid-plane of said lock.

13. A multiple key lock as defined in claim 10, wherein said tumbler levers are normally disposed in interfering relation to said gate members along the direction of movement of the gate members with the slide bolt from locking to unlocking position and wherein said tumbler levers are shaped and positioned to occupy non-interfering relation to movement of said tumbler levers and bolt from locking position to unlocking position only when the renter's tumbler levers are displaced by contact with the proper renter's key with said key follower surfaces and said guard tumbler levers are displaced by contact of their associated key follower surfaces with a proper guard key.

14. A multiple key lock as defined in claim 10, wherein said gate members have gated edges confronting said tumblers and a plurality of teeth along an edge thereof opposite the gated edges of said gate members, and said gate locator means is a slide member having a holding tooth insertable into interleaving relation between teeth of said gate members when said gate release cam is in a predetermined position to hold the gate members in positions corresponding to the configuration of renter's and guard keys for which the lock is set.

15. A multiple key lock as defined in claim 13, wherein said gate members have gated edges confronting said tumblers and a plurality of teeth along an edge thereof opposite the gated edges of said gate members, and said gate locator means is a slide member having a holding tooth insertable into interleaving relation between teeth of said gate members when said gate release cam is in a predetermined position to hold the gate members in positions corresponding to the configuration of renter's and guard keys for which the lock is set.

16. A lock requiring two different keys for operation of the lock to unlocking position, comprising a lock housing, a slide bolt mounted in the housing for sliding movement between projected and retracted positions, a plurality of gate members each having a gating recess, means mounting said gate members in said housing for movement with said slide bolt, a first set of a plurality of tumbler levers to be positioned by a first key, means for mounting said tumbler levers of said first set in said housing positioning them normally in interfering relation to a first set of said gate members and mounting said tumbler levers for movement under operation of said first key in said lock to a non-interfering position, a second set of a plurality of tumbler levers to be positioned by a second key, means for mounting the tumbler levers of said second set in said housing positioning them normally in interfering relation to a second set of said gate members and mounting them for movement under operation of said second key in said lock to a non-interfering position, said tumbler levers having portions disposed to engage said gate members and prevent movement of said slide bolt to unlocking position until both said first and second keys have been inserted in said lock and are positioned to concurrently hold said two sets of tumbler levers in said non-interfering position relative to said two sets of gate means whereby the gate members are then released to permit retraction of said bolt to unlocking position, said bolt including gate locator means having a projection to be interfitted in holding relation with an edge of each of said gate members and movable between a gate-holding and gate-releasing position, and a rotatable gate release cam carried by said bolt and intercoupled with said gate locator means for shifting the same between gate-holding and gate-releasing position, said gate release cam being alinable with an opening in said housing when said bolt is in a predetermined intermediate position between said projected and retracted positions for insertion of a tool to shift the gate release cam between positions disposing said gate locator means at gate-holding and gate release positions.

17. A multiple key lock as defined in claim 16, wherein said gate members have gated edges confronting said tumblers and a plurality of teeth along an edge thereof opposite the gated edges of said gate members, and said gate locator means is a slide member having a holding tooth insertable into interleaving relation between teeth of said gate members when said gate release cam is in a predetermined position to hold the gate members in positions corresponding to the configuration of renter's and guard keys for which the lock is set.

18. A multiple key lock for safe deposit boxes and the like comprising a lock housing, a bolt slidably supported in said housing for movement between a projected locking position and a retracted unlocking position, a plurality of platelike gate members releasably carried by said bolt to prevent movement of the bolt from said locking position toward unlocking position until a plurality of mating tumbler levers operated by a renter's key and a guard key are alined in selected relation to each of the gate members, the improvement permitting changing of both the renter's key and the guard key for opening the lock comprising a first set of a plurality of renter's key tumbler levers pivotally mounted adjacent one end on a common pivot axis and having first key follower surfaces on each tumbler lever thereof to be engaged by a renter's key insertable in said lock, the lock having renter's key-receiving means spaced laterally of said common pivot axis and located adjacent said key follower surfaces, and a second set of a plurality of guard key tumbler levers pivotally mounted on said common pivot axis and having second key follower surfaces on each said guard key tumbler lever to be engaged by a guard key insertable in said lock, the lock having guard key-receiving means spaced laterally of said common pivot axis oppositely disposed relative to the renter's key receiving means, whereby adjustment of the gate members carried by said bolt relative to each of the two sets of tumbler levers permits changing of the customer and guard keys, said bolt including gate locator means having a projection to be interfitted in holding relation with an edge of each of said gate members and movable between a gate-holding and gate-releasing position, and a rotatable gate release cam carried by said bolt and intercoupled with said bolt locator means for shifting the same between gate-holding and gate-releasing position, said gate release cam being alinable with an opening in said housing when said bolt is in a predetermined intermediate position between said projected and retracted positions for insertion of a tool to shift the gate release cam between positions disposing said gate locator means at gate-holding and gate release positions.

19. A multiple key lock as defined in claim 18, wherein said gate members have gated edges confronting said tumblers and a plurality of teeth along an edge thereof opposite the gated edges of said gate members, and said gate locator means is a slide member having a holding tooth insertable into interleaving relation between teeth of said gate members when said gate release cam is in a predetermined position to hold the gate members in positions corresponding to the configuration of renter's and guard keys for which the lock is set.

* * * * *